US005645456A

United States Patent [19]

Petersen et al.

[11] Patent Number: 5,645,456

[45] Date of Patent: Jul. 8, 1997

[54] ELECTRICAL CONNECTOR WITH CABLE ATTACHMENT

[75] Inventors: Carl C. Petersen, Danbury; Robert J. Shiley, II, Monroe; Frederick D. J. Hooper, Norwalk, all of Conn.

[73] Assignee: Burndy Corporation, Norwalk, Conn.

[21] Appl. No.: 458,574

[22] Filed: Jun. 2, 1995

[51] Int. Cl.[6] ..... H01R 11/09

[52] U.S. Cl. ..... 439/724

[58] Field of Search ..... 439/721, 723, 439/724, 787, 527, 596

[56] References Cited

U.S. PATENT DOCUMENTS

| | | | |
|---|---|---|---|
| 3,047,835 | 7/1962 | Kelly | 439/724 |
| 3,980,380 | 9/1976 | Cieniawa et al. | 339/99 R |
| 4,614,399 | 9/1986 | Gemra et al. | 339/205 |
| 4,624,525 | 11/1986 | Ichimura et al. | 339/177 R |
| 4,693,537 | 9/1987 | Dinsmore et al. | 439/399 |
| 5,167,532 | 12/1992 | Bruno et al. | 439/578 |
| 5,192,233 | 3/1993 | Suffredini et al. | 439/723 |
| 5,310,364 | 5/1994 | Hooper et al. | 439/724 |

*Primary Examiner*—David L. Pirlot
*Assistant Examiner*—Yong Ki Kim
*Attorney, Agent, or Firm*—Perman & Green

[57] ABSTRACT

An electrical connector with a frame and an electrical contact mounted to the frame. The frame has a general clamshell design adapted to surround a portion of a cable to mechanically connect the frame to the cable. The frame has an elongate C-shaped member with an outer section and an inner section. The contact is sandwiched between the two sections. The contact has a curved busing strip with contact terminals extending in opposite directions from the busing strip.

20 Claims, 3 Drawing Sheets

ELECTRICAL CONNECTOR WITH CABLE ATTACHMENT

BACKGROUND OF THE INVENTION

1. Field of the Invention

This invention relates to an electrical connector and, more particularly, to a connector for electrically connecting conductors that can be mechanically attached to a cable.

2. Prior Art

U.S. Pat. Nos. 5,310,364 and 5,192,233 disclose a grounding block that can be attached to a frame of an aircraft. U.S. Pat. No. 4,614,399 discloses a splice connector. U.S. Pat. No. 3,980,380 discloses an electrical connector with radially arranged conductor contacts. U.S. Pat. No. 5,167,532; 4,693,537 and 4,624,525 disclose coaxial electrical connectors.

SUMMARY OF THE INVENTION

In accordance with one embodiment of the present invention, an electrical junction connector is provided comprising a frame and an electrical contact mounted to the frame. The frame is adapted to surround a portion of an electrical cable for mechanically connecting the frame to the cable. The contact has at least two contact terminals for connection to two separate conductors wherein the two conductors are electrically connected to each other by the contact and are mechanically connected to the cable by the frame.

In accordance with another embodiment of the present invention, an electrical connector is provided comprising a frame and at least one electrical contact connected to the frame. The frame has a general clamshell configuration adapted to surround a portion of an electrical cable. The contact has a busing strip interconnecting separate contact terminals. The busing strip has a general curved profile.

In accordance with another embodiment of the present invention, an electrical connector is provided comprising a frame and an electrical contact. The frame has a C-shaped member. The C-shaped member has a general C-shaped outer section and a general C-shaped inner section. The electrical contact is sandwiched between the inner and outer sections to fixedly connect the contact to the frame.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENTS

Figure 1:
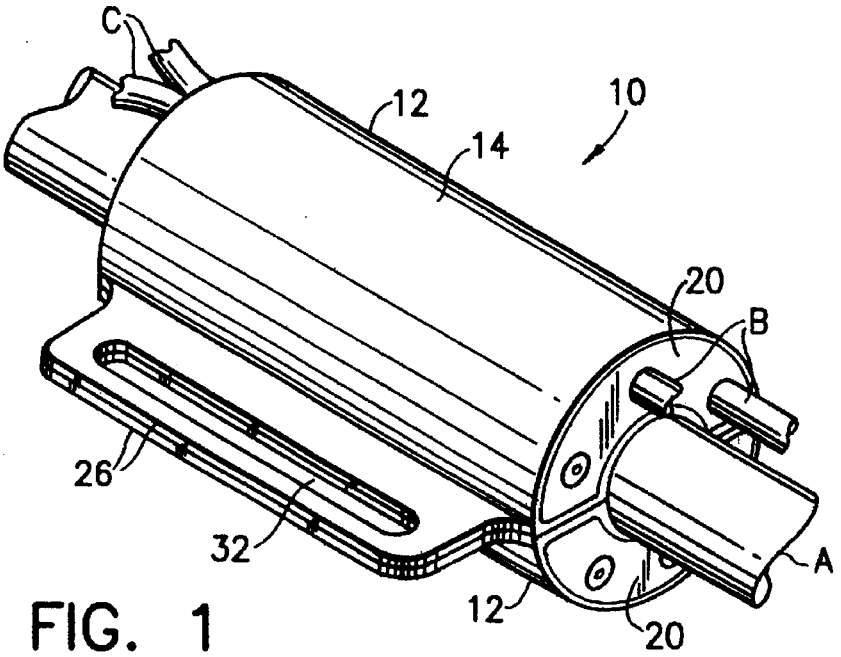
FIG. 1 is a perspective view of an electrical connector incorporating features of the present invention shown attached to a cable and having electrical conductors connected therewith.

Referring to FIG. 1, there is shown a perspective view of an electrical connector 10 incorporating features of the present invention. Although the present invention will be described with reference to the embodiments shown in the drawings, it should be understood that the present invention can be embodied in various different types and kinds of alternate embodiments. In addition, any suitable size, shape or type of elements or materials could be used.

Figure 2:
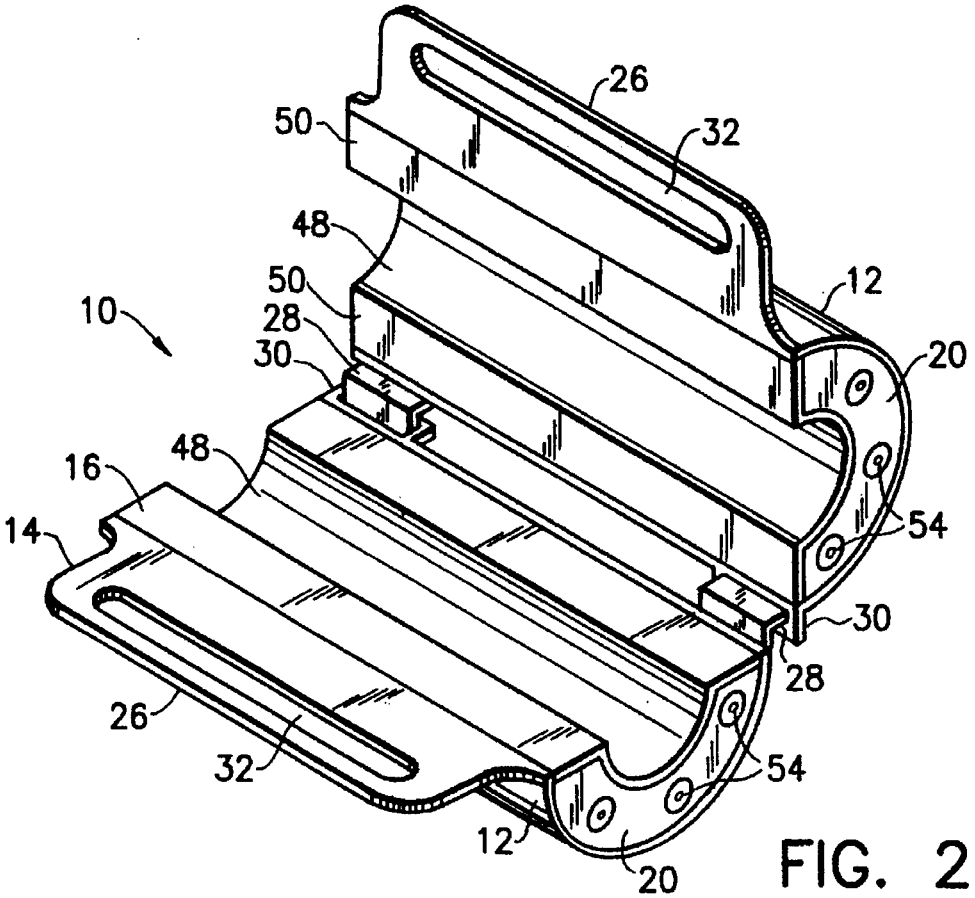
FIG. 2 is a perspective view of the electrical connector shown in FIG. 1 in an open unattached positioned.

Referring also to FIG. 2, the connector 10 generally comprises two general C-shaped members or modules 12. The connector 10 is a general donut shaped combined anchor and splice connector. In FIG. 1 the connector 10 is shown in a closed position mechanically attached to a cable A and having four electrical conductors B, C mechanically and electrically connected to the connector 10. In FIG. 2, the connector 10 is shown in an open position. In the embodiment shown, the two members 12 are the same and are hermaphroditic.

Figure 3:
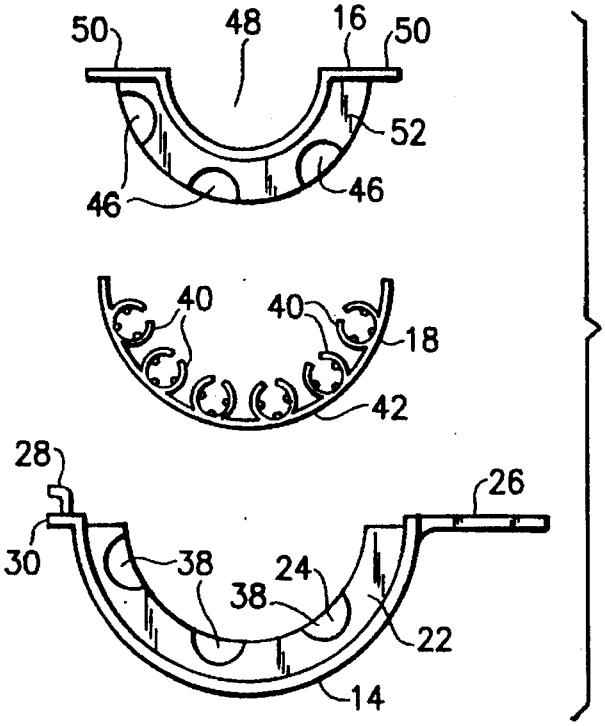
FIG. 3 is an exploded end view of one of the C-shaped members shown in FIG. 2.
Figure 4:
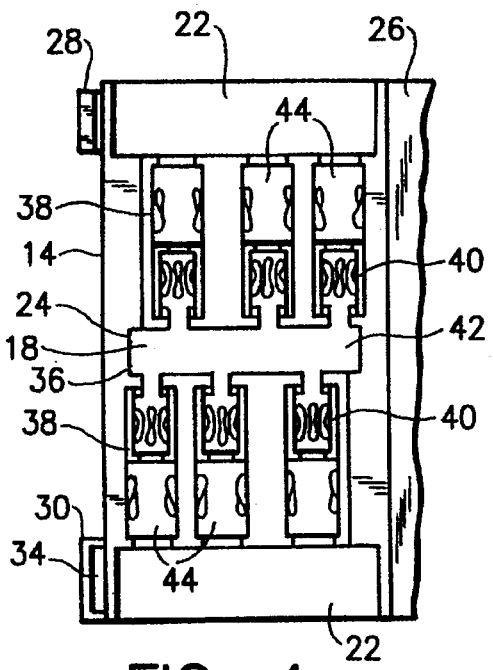
FIG. 4 is a plan top view of the outer C-shaped section shown in FIG. 3 with the electrical contact positioned in the contact seat.
Figure 5:
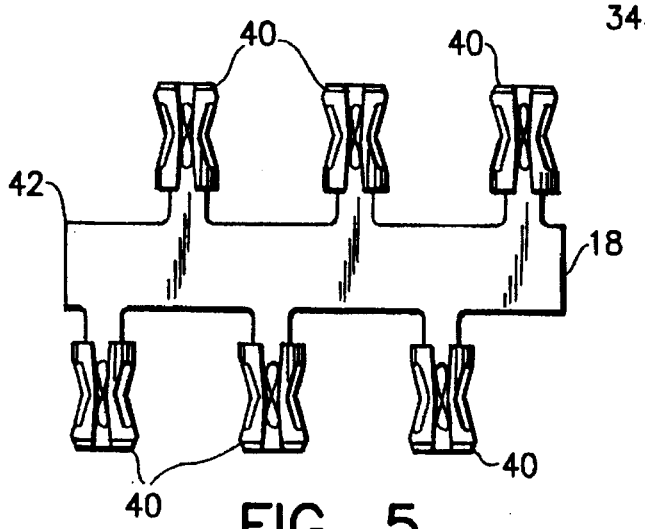
FIG. 5 is a plan top view of the electrical contact shown in FIG. 3 prior to its busing strip being curved.

Referring also to FIGS. 3–5, each member 12 includes a general C-shaped outer section 14, a general C-shaped inner section 16, at least one electrical contact 18, and two grommets 20 (only one of which is shown for each member). The outer and inner sections 14, 16 are preferably made of a relatively rigid dielectric material, such as a plastic or polymer material. The grommets 20 are preferably made of a resiliently deformable polymer or rubber material. The outer section 14 includes grommet recesses 22, a contact seat 24, a first main flange 26 extending from one side of the outer section 14, and second and third flanges 28, 30 extending from the opposite side of the outer section 14. The first flange 26 has a slot 32 therethrough. The second flange 28 is an L-shaped male flange. The third flange 30 is a female flange with an aperture 34. The contact seat 24 has a center recessed section 36 and six terminal recessed sections 38. However, any suitably shaped contact seat could be provided.

The electrical contact 18 is made from stamped and formed sheet metal. The contact 18 has six female terminals 40 interconnected by a busing strip 42. The busing strip 42 has a curved profile as shown in FIG. 3. FIG. 5 shows a top view of the contact before the busing strip 42 is bent. The contact 18 is located in the contact seat 24 of the outer section 14. The busing strip 42 is received in the center recessed section 36. The terminals 40 are individually received in the six terminal recessed sections 38. The connector 10 also has retainer clips 44. The retainer clips 44 are positioned in the terminal recessed sections 38 between the terminals 40 and the grommet recesses 22. A separate retainer clip 44 is provided for each terminal 40. In alternate embodiments other types of contacts and/or retainer clips could be used.

The inner section 16 includes six terminal recessed sections 46, main channel 48, and flanges 50. The terminal recessed sections 46 are suitably located to cooperate with the terminal recessed sections 38 to hold the terminals 40 and retainer clips 44 therein. More specifically, the outer section 14 and inner section 16 sandwich the contact 18 and retainer clips 44 therebetween. The inner section 16 is fixedly connected to the outer section 14, such as by ultrasonic welding. The inner section 16 also has grommet recesses 52 (only one of which is shown). The recesses 22 and 52 have the grommets 20 fixedly mounted thereby, such as by adhesive. The grommets 20 each have three conductor apertures 54 therethrough. The apertures 54 align with the recesses 38, 46.

As seen in FIG. 2, due to the hermaphroditic design of the members 12, two of the members can be reversely connected to each other at the second and third flanges 28, 30. More specifically, the mating flanges act as a hinge to close the two members 12 onto each other as shown in FIG. 1. The main channels 48 establish an area through which a cable or a bundle of individual wires (collectively referred to as a cable) can pass. Thus, as shown in FIG. 1, the frame of the connector 10 can be closed over a cable to thereby attach the connector to the cable. A fastener (not shown) can be attached at the slots 32 to thereby fix the two members in the closed position. In alternative embodiments, the members 12 could have integral fastening sections to fixedly mate with each other. The slots 32 also allow the connector 10 to be connected to another member (not shown), such as a frame of an aircraft, by a suitable fastener (not shown). In alternate embodiments, the connector 10 could have integral fastening sections to fixedly attach the connector to the other member (not shown).

The two members 12 act as a junction or splice between the first conductors B and the second conductors C. A suitable male contact (not shown) is attached to each of the conductors B, C. The male contacts (not shown) are each inserted through one of the grommet apertures 54 into fixed retainment with one of the retainer clips 44 and into electrical connection inside one of the female terminal 40. The busing strip 42 of the contact 18 electrically interconnects each of the terminals 40. Therefore, the first conductors B are electrically connected to second conductors C connected to the same member 12. The connector 10 also mechanically connects the conductors B, C to the cable A and perhaps another member.

Figure 6:
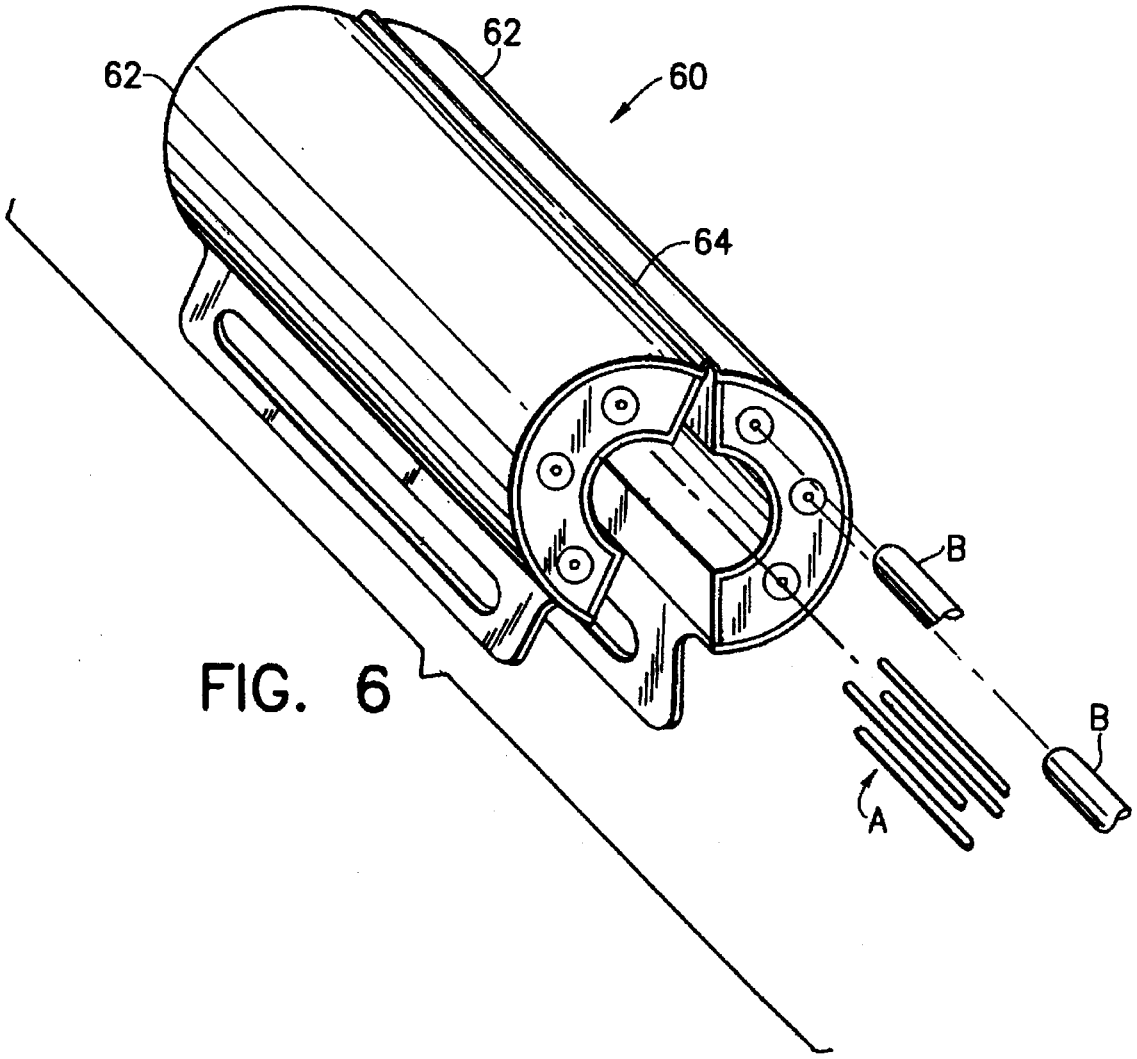
FIG. 6 is a perspective view of an alternate embodiment of the electrical connector shown in FIG. 1.

Referring now to FIG. 6, there is shown an alternate embodiment of the present invention. In this embodiment the connector 60 has its two C-shaped members 62 hinged together by an integral hinge 64. The hinge 64 is integrally formed between the two outer sections 14. The hinge, in the embodiment shown, is merely flexible plastic which the outer sections 14 are formed from. However, any suitable type of hinge could be provided. The two members 62 pivot at the hinge 64 to mount the connector 60 on the bundle of wires A. In the embodiment shown, the wires B that become connected to the contact in the member 12 are from the bundle of wires A. Therefore, the connector 60; when connected to a frame, serves to support the wire bundle A on that frame and, provides a terminal junction to the wires B from the main bundle A and wires to nearby devices. The semi-circular shape of the members 12 saves space and allows 360° access to all the wires. The connector of the present invention is easy to install and requires no extra nylon ties for the bundle of wires A even though wires B are being separated from the bundle. The connector itself replaces the need for extra nylon ties.

Figure 7:
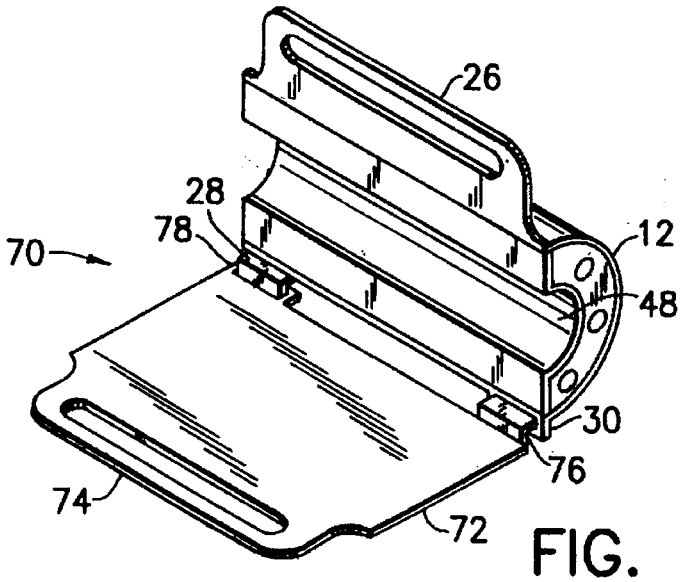
FIG. 7 is a perspective view of another alternate embodiment of the electrical connector shown in FIG. 1.

FIG. 7 shows a perspective view of another embodiment of the present invention. In this embodiment, the connector 70 includes a C-shaped member 12 and a non-electrical clamping plate member 72. The member 72 does not contain an electrical contact. The member 72 is a plate having three flanges 74, 76, 78 that are similar to the three flanges 26, 28, 30 on the member 12. The flanges 28, 78 and 30, 76 function as a hinge. The member 72 can be closed on the member 12 to capture wires or a cable in channel 48. In alternate embodiments, any suitable non-electrical member could be used to mate with the member 12. Multiple separate contacts could also be provided in each member 12. The contacts 18 can be used to redistribute to nearby devices requiring power, switched power, grounding, signal circuits, etc. The purpose of the connector 70 is to physically support the bundle A, such as by attaching the flanges 26, 74 to an aircraft frame, and provide a terminal junction from source wires from within the bundle to wires going to nearby devices.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical junction connector comprising:

a frame adapted to surround a portion of an electrical cable for mechanically connecting the frame to the cable; and an electrical contact mounted in the frame, the contact being comprised of a sheet metal member cut and formed to have at least two contact terminals for connection to two separate conductors, wherein the two conductors are electrically connected to each other by the contact and are mechanically connected to the cable by the frame.

2. A connector as in claim 1 wherein the frame has a general clamshell configuration.

3. A connector as in claim 2 wherein the frame has two generally C-shaped members connected to each other by an integral hinge.

4. A connector as in claim 2 wherein the frame has two generally C-shaped hermaphroditic members.

5. A connector as in claim 1 wherein the frame has a central passage that the cable passes through.

6. A connector as in claim 1 wherein the frame has an elongate C-shaped member with a general C-shaped outer section, a general C-shaped inner section, and having the electrical contact sandwiched between the inner and outer sections.

7. A connector as in claim 1 wherein the electrical contact includes a busing strip that electrically connects the two contact terminals to each other.

8. A connector as in claim 1 wherein the electrical contact has a general curved protile.

9. A connector as in claim 1 further comprising retainer clips located in the frame in front of each of the contact terminals.

10. A connector as in claim 1 wherein the frame includes an integral flange for fixedly connecting the frame to another member.

11. An electrical connector comprising:

a frame having a general clamshell configuration adapted to surround a portion of an electrical cable wherein the frame comprises two generally elongate C-shaped members connected by an integral hinge; and at least one electrical contact mounted to the frame, the contact having a busing strip interconnecting separate contact terminals, the busing strip having a general curved profile.

12. A connector as in claim 11 wherein the frame includes general C-shaped inner sections, the contact being sandwiched between one of the inner sections and one of the outer sections.

13. A connector as in claim 12 wherein each of the outer sections includes a contact seat projecting into its interior side.

14. A connector as in claim 13 wherein each of the inner sections includes a contact seat projecting into its outer side.

15. A connector as in claim 14 further comprising retainer clips located in the contact seats.

16. A connector as in claim 11 wherein the terminals extend in opposite directions from the curved busing strip.

17. An electrical connector comprising:

a frame having a C-shaped member, the C-shaped member having a general C-shaped outer section and a general C-shaped inner section; and an electrical contact sandwiched between the inner and outer sections to fixedly connect the contact to the frame.

18. A connector as in claim 17 further comprising means for connecting the frame to an electrical cable, the frame surrounding a portion of the cable.

19. A connector as in claim 17 wherein the electrical contact has a general curved configuration.

20. A connector as in claim 19 wherein the electrical contact has a curved busing strip and contact terminal extending in opposite directions from the busing strip.

* * * * *